United States Patent [19]

Liming

[11] Patent Number: 4,531,513

[45] Date of Patent: Jul. 30, 1985

[54] REMOVABLE HANDLE FOR A ROLLER MASSAGER

[76] Inventor: Joseph L. Liming, 3439 Franklin Rd., Felicity, Ohio 45120

[21] Appl. No.: 553,031

[22] Filed: Nov. 18, 1983

[51] Int. Cl.[3] ..... A61H 15/00

[52] U.S. Cl. ..... 128/57

[58] Field of Search ..... 128/24.3, 57, 58, 67, 128/62 R; D24/36, 41; 446/95, 466, 469

[56] References Cited

U.S. PATENT DOCUMENTS

| | | | |
|---|---|---|---|
| D. 166,050 | 2/1952 | Sandholm . | |
| D. 204,046 | 3/1966 | Ziglin . | |
| D. 254,507 | 3/1980 | Redding . | |
| D. 256,841 | 9/1980 | Corbett et al. . | |
| 681,331 | 8/1901 | Milkman . | |
| 699,916 | 5/1902 | Gerling . | |
| 1,257,957 | 2/1918 | Kost . | |
| 1,310,950 | 7/1919 | Heagany . | |
| 1,513,475 | 10/1924 | Bell . | |
| 1,671,019 | 5/1928 | Falck . | |
| 1,757,004 | 5/1930 | Chapin . | |
| 1,901,001 | 3/1933 | Rohleder . | |
| 1,910,490 | 5/1933 | Lucas . | |
| 2,273,710 | 2/1942 | Klaes . | |
| 2,512,904 | 6/1950 | Strelecky . | |
| 2,572,627 | 10/1951 | Kelly . | |
| 2,578,916 | 12/1951 | Belleville . | |
| 2,593,982 | 4/1952 | Cash . | |
| 2,599,367 | 6/1952 | Brucato . | |
| 2,683,454 | 7/1954 | Brandenfels | 128/57 |
| 2,698,014 | 12/1954 | Brandenfels | 128/57 |
| 2,748,763 | 6/1956 | Kosloff . | |
| 2,767,707 | 10/1956 | Toivonen . | |
| 3,060,928 | 10/1962 | Lowe . | |
| 3,415,514 | 12/1968 | Weihs . | |
| 3,616,794 | 11/1971 | Gromala . | |
| 3,645,256 | 2/1972 | Morrison . | |
| 3,756,223 | 9/1973 | Carbone . | |
| 3,756,224 | 9/1973 | Laymon . | |
| 4,067,324 | 1/1978 | Creenawalt . | |
| 4,109,649 | 8/1978 | Iyomasa . | |
| 4,127,116 | 11/1978 | Pannetier . | |
| 4,142,519 | 3/1979 | Ferguson . | |
| 4,167,940 | 9/1979 | Ruf . | |
| 4,191,179 | 3/1980 | Mattila . | |
| 4,198,962 | 4/1980 | McCauley . | |
| 4,205,663 | 6/1980 | Fujiwara . | |
| 4,210,135 | 7/1980 | Deuser . | |
| 4,230,098 | 10/1980 | Uematsu . | |

FOREIGN PATENT DOCUMENTS

| | | |
|---|---|---|
| 414818 | 12/1925 | Fed. Rep. of Germany . |
| 2218878 | 10/1973 | Fed. Rep. of Germany . |
| 2530607 | 10/1976 | Fed. Rep. of Germany . |
| 769422 | 2/1934 | France . |
| 197715 | 5/1938 | Sweden . |
| 880289 | 10/1961 | United Kingdom . |

*Primary Examiner*—Richard J. Apley
*Assistant Examiner*—David J. Brown
*Attorney, Agent, or Firm*—Wood, Herron & Evans

[57] ABSTRACT

A removable handle for a roller massager of the type that includes a series of roller rows connected into a massager unit through use of straps oriented along each side of the matrix. The straps interconnect the rollers' axles one with the other to establish the roller matrix. The removable handle is a one piece molded handle that carries a series of connector brackets hingedly mounted along each side. Each connector bracket is adapted to interconnect with a strap and an axle to prevent longitudinal, transverse and normal motion of the handle relative to the roller plane. These interconnections permit the handle to be connected with or disconnected from the roller massager as desired by the user.

15 Claims, 5 Drawing Figures

REMOVABLE HANDLE FOR A ROLLER MASSAGER

This invention relates to massagers. More particularly, this invention relates to a massager of the roller type.

Roller massagers are well known to the art, and have been in use for years. A roller massager basically includes a series of rollers carried in a frame in matrix fashion. In other words, a roller massager comprises a series of columns and rows of rollers that are mounted within a framework for end use. Typical uses of a roller massager include massaging a person's foot, or a person's back, and the like. In the case of a foot type roller massager, one face of the roller matrix is simply placed on the floor. The user's foot is then pushed down against the exposed face of the roller matrix while rolling the massager back and forth on the floor under the foot to massage the foot. In the case of a back massager, the roller matrix usually is provided with some kind of handle. The handle is grasped by the user, and an exposed face of the roller matrix is rolled over the individual's back to massage the back.

It has been the objective of this invention to provide a removable handle for a roller massager so that the roller matrix can be used as a foot massager in the fashion described above (where no handle is desired), or so that the massager can be used on other body parts, e.g., back or the like (where a handle is desirable).

In accord with this objective, this invention contemplates a removable handle for a roller massager of the type that includes a series of roller rows connected into a massager unit through use of straps oriented along each side of the matrix. The straps interconnect the rollers' axles one with the other to establish the roller matrix. The removable handle, in one preferred form, is a one piece molded handle that carries a series of connector brackets hingedly mounted along each side. Each connector bracket is adapted to interconnect with a strap and an axle to prevent longitudinal, transverse and normal motion of the handle relative to the roller plane. These interconnections permit the handle to be connected with or disconnected from the roller massager as desired by the user. Other objectives and advantages of this invention will be more apparent from the following detailed description taken in conjunction with the drawings in which:

Figure 1:
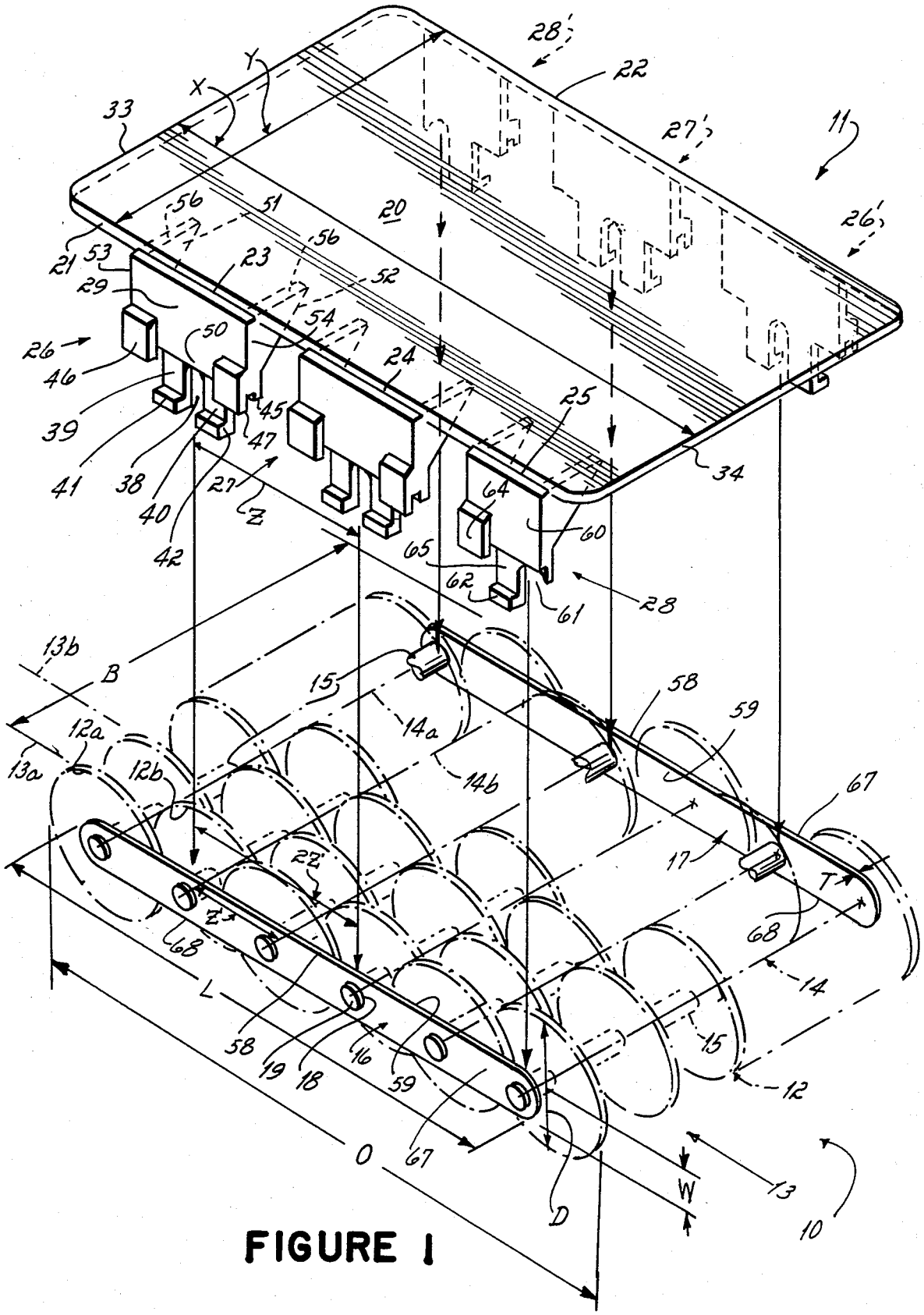
FIG. 1 is an exploded perspective view illustrating a roller massager with a removable handle in accord with the principles of this invention, the handle being separated or disconnected from the roller massager.

A roller massager 10 used in combination with a removable handle 11 in accord with this invention is shown particularly in FIG. 1. The roller massager 10 basically is comprised of a series of rollers 12 disposed in columns 13 and rows 14 in matrix fashion. Each row 14 of rollers 12 is comprised of a series of rollers or discs that are integrally molded with an axle 15. Note adjacent columns 13*a*, 13*b* of the roller 12 matrix are offset relative one to the other. And this offset between adjacent columns 13*a*, 13*b* permits the rollers 12*a*, 12*b* of adjacent rows 14*a*, 14*b* to be interleaved one with the other even though the axles 15 of all roller rows 14 are of the same length. In the embodiment shown, the rollers 12 or discs are molded integral with their respective axles 15 of a plastic, e.g., polypropylene.

The rows 14 of rollers 12 are held in the maxtrix configuration shown in FIG. 1 through use of side straps 16, 17. The side straps 16, 17 are provided with bores 18 that receive ends 19 of the axles 15 in a snap fit connector relation. In effect, all rollers 12 are held in the matrix configuration by the side straps 16, 17, each side strap being connected with one end of all axles 15 in the roller matrix. Note the width W of each side strap 16, 17 is significantly less than the diameter D of the rollers 12, and note that the length L of each side strap is less than the overall length O of the roller matrix. The width W and thickness T of each of the side straps 16, 17 is identical so that the massager's handle 11 can connect with both straps in any one of two orientations as explained in further detail below.

Figure 3:
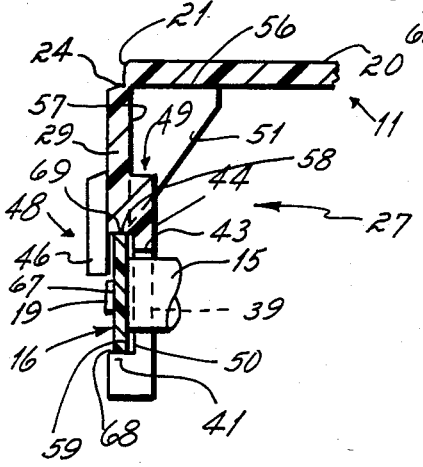
FIG. 3 is a cross-sectional view taken along line 3—3 of FIG. 2.
Figures 4, 5:
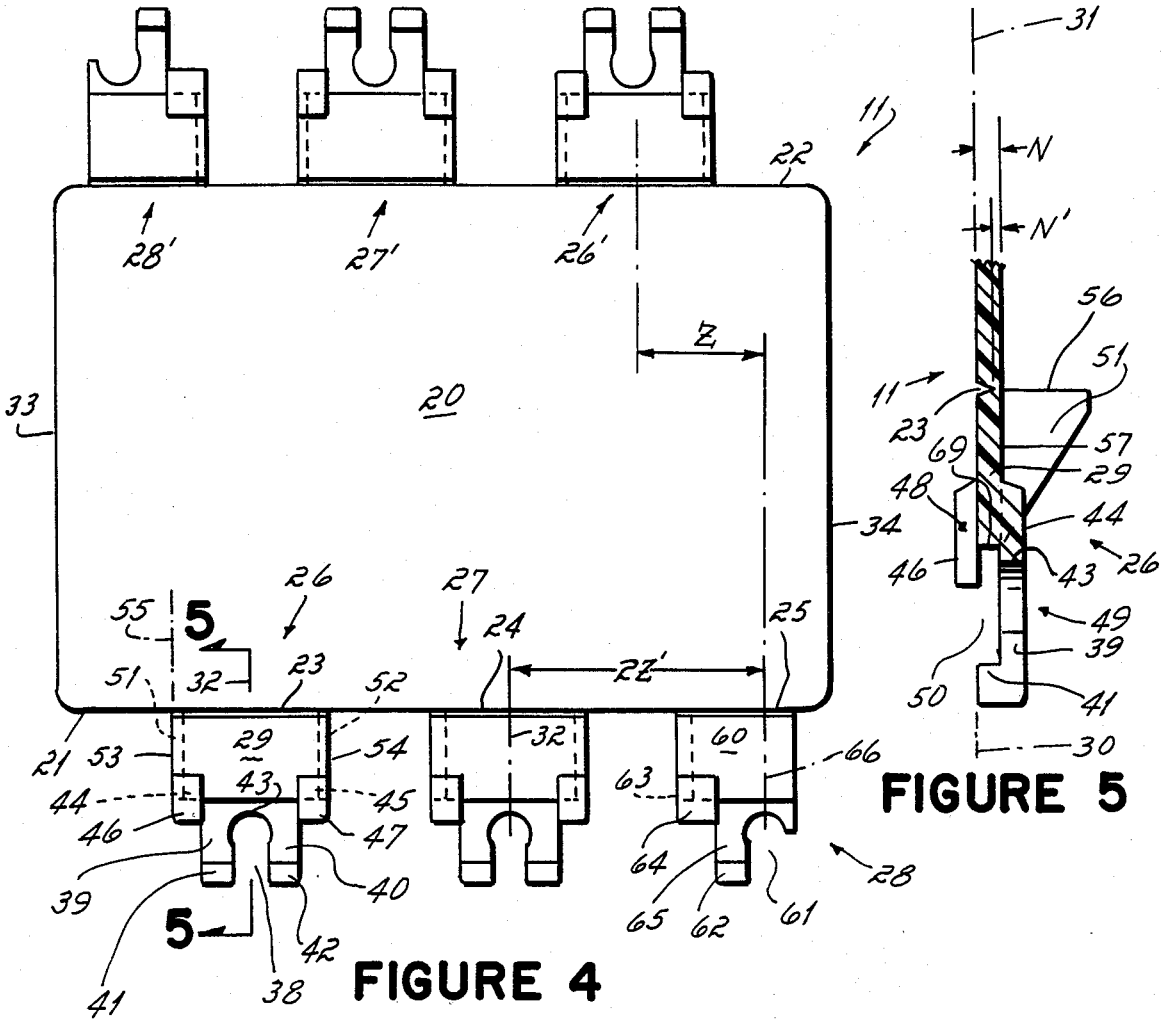
FIG. 4 is a top view illustrating the removable handle in its shipping or storage attitude.
FIG. 5 is a cross-sectional view taken along line 5—5 of FIG. 4.

The removable handle 11 for the roller massager 10 is shown particularly in FIGS. 1 and 3–5. The removable handle 11 basically comprises a base plate 20 that has length X and breadth Y dimensions less than the length 0 and breadth B dimensions of the roller 12 matrix. Each side edge 21, 22 of the base plate 20 is connected by living hinges 23–25 with a series of three strap connectors 26–28, 26'–28'. The removable handle 11, i.e., the base plate 20 and strap connectors 26–28, 26'–28', is formed of a single one piece molded configuration of plastic, e.g., polypropylene. The living hinges 23–25 are simply of a thickness N' less than half the thickness N of the base plate 20, i.e., less than half the thickness N of each strap connector's web 29, thereby permitting the strap connectors 26–28 to fold between a shipping or storage position as shown in FIGS. 4 and 5 where the general plane 30 of each strap connector is substantially coplanar with the plane 31 of the base plate, and a operational or use position as shown in FIGS. 1 and 3 where the general plane of each strap connector is substantially normal to the general plane of the base plate. This is an important practical consideration in that it reduces packaging costs, as well as shipping volume, when transferring the product from manufacturer through distribution channels to a retail consumer who is the end user.

Note that each strap connector 26–28 defines a center line 32 that coincides with a row axis 14 when the handle is assembled with the roller massager 10, and that adjacent center lines 32 of opposite strap connectors 26–28, 26'–28' are spaced a distance Z between one another equal to the distance Z' between the row axes. Note also, however, that on each of the two side edges 21, 22 of the handle's base plate 20 that adjacent strap connectors 26–28, 26'–28' are spaced one from the other a distance equal to the distance 2Z' between three row axes 14. And further in this regard, the strap connectors 26–28, 26'–28', as particularly shown in FIG. 4, alternate from side edge 22 to side edge 23 of the base plate 20 so that each strap connector connects with only one row axle 15, i.e., so that each roller row 14 of the roller matrix 13, 14 is interconnected with only one strap connector. In this regard, the strap connectors 28, 28' most closely adjacent the end edges 33, 34 of the base plate 20 are in effect only half strap connectors vis-a-vis the full strap connectors 26, 26', 27, 27' that serve the other roller rows.

Each of the full strap connectors 26, 27, 26', 27', as shown in the figures, includes a centered (relative to center line 32) snap fit keyhole slot 38 sized to receive a row axle 15. On each side of legs 39, 40 that define the keyhole slot 38, and at the free end of that open ended keyhole slot, there is provided an inside foot 41, 42. At the closed end 43 of the keyhole slot, and on either side thereof, there is provided an inside finger 44, 45 and an outside finger 46, 47. The inside 44, 45 and outside 46, 47 fingers cooperate to define an upper yoke 48 as shown in FIG. 3, and the inside finger 44, 45 and inside feet 41, 42 cooperate to define an inner yoke 49 also as shown in FIG. 3. When each of the full strap connectors 26, 27, 26', 27' is viewed from the side view as shown in FIG. 4, note that each pair 44, 46 and 45, 47 of inside and outside fingers is aligned one with the other, and that each pair 44, 46 and 45, 47 of inside and outside fingers is located outboard of an inside foot 41, 42, respectively, relative to the open ended keyhole slot 38 defined by legs 39, 40. Note particularly, and as shown in FIG. 3, that the inside 44, 45 and outside 46, 47 fingers of each strap connector 26, 26', 27, 27', in combination with the inside feet 41, 42 of that strap connector, cooperate to define an open sided, open ended snap fit longitudinal slot 50 adapted to receive the roller massager's side strap 16 or 17. The inside 44, 45 and outside 46, 47 fingers of each full connector 26, 27, 26', 27', and the legs 39, 40 of each full connector, are formed integral with web 29, and it is this web that is connected with the handle's base plate 20 by living hinge 23, 24 so as to interconnect the full strap connector 26, 26', 27, 27' with the handle's base plate.

Each of these full strap connectors 26, 27, 26', 27', on the inside face thereof, also includes a gusset 51, 52 along opposed side edges 53, 54 of the web 29. The gussets 51, 52 are formed in a plane 55 transverse to the general plane 30 of the strap connector, and are located on the inside face 57 of that web. The gussets 51, 52 each provide a bearing edge 56, 57 that coincides with hinge line 23 or 24 defined by the web's interconnection with base plate 20.

Each of the end edge strap connectors 28, 28' is, in effect, one-half of a full strap connector 26, 26', 27, 27'. Each end strap connector 28, 28' includes a web 60, a partial snap fit keyhole slot 61, one inside foot 62, one inside finger 63, one outside finger 64, and one leg 65, all as shown in FIG. 4. These components 60–65 are all oriented on one side of the connector's center line 66.

There are two modes of use of the roller massager 10 of this invention. The first mode of use is without the removable handle 11 attached. The roller massager 10 shown in FIG. 1, where the handle is detached, can simply be placed on a floor (not shown). A person then places his foot (not shown) on top the roller massager and moves or rolls the massager back and forth on the floor with his foot thereon. This massages the bottom of the person's foot.

Figure 2:
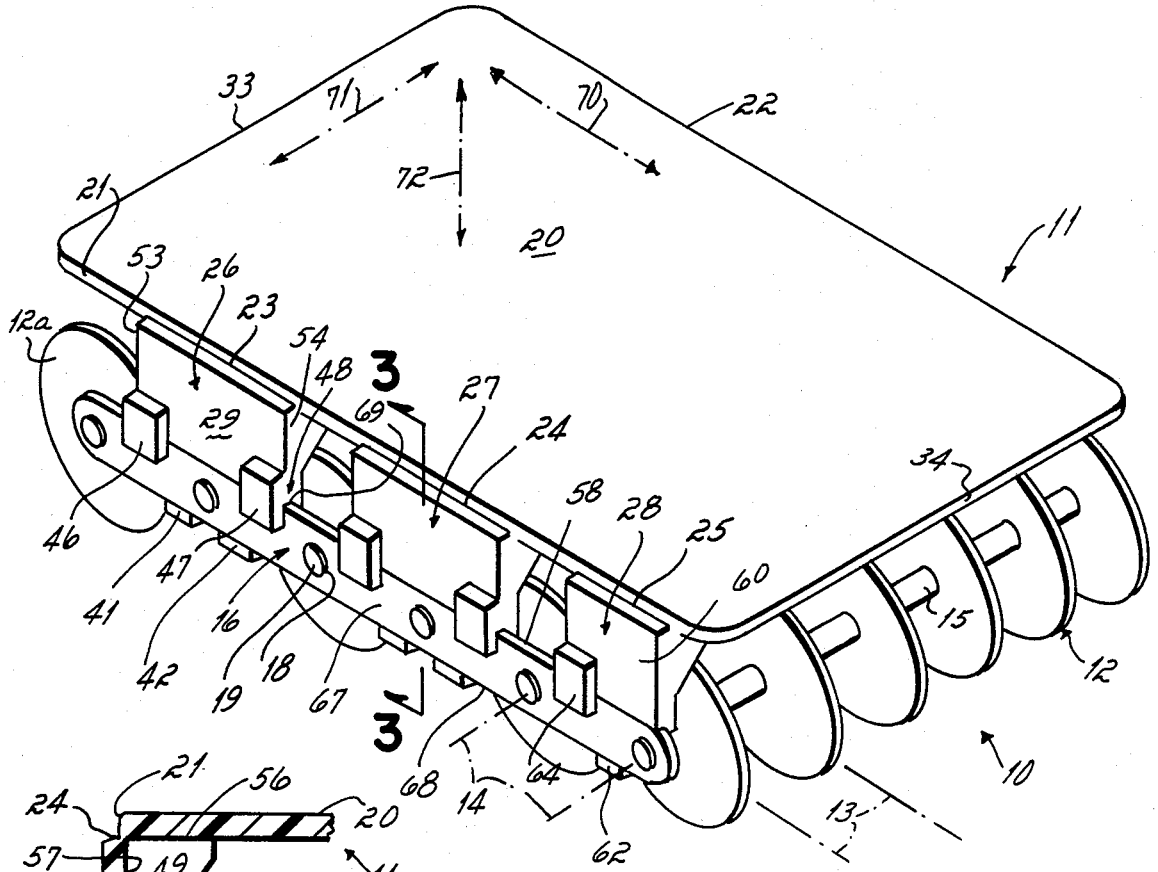
FIG. 2 is a perspective view similar to FIG. 1, but illustrating the removable handle in operable combination with the roller massager.

The second use mode of the roller massager 10 is with the removable handle attached. And it is this aspect of the invention, i.e., the removable handle 11, that constitutes the improvement to the prior art. As shown particularly in FIG. 4, the handle's base plate 20 and the handle's strap connectors 26–28, 26'–28' can be oriented in generally the same plane, see FIG. 5. This permits the handle 11 to be stored flat, thereby reducing packaging and shipping costs to the manufacturer. The living hinges 23–25 by which the strap connectors 26–28, 26'–28' can be oriented in planes 30 normal to the base plate plane 31, as shown in FIGS. 1 and 3, permit the removable handle to be easily erected from the storage attitude shown in FIGS. 4 and 5 to the use attitude illustrated in FIGS. 2 and 3. With the strap connectors 26–28, 26'–28' oriented as shown in FIG. 1, the strap's slot 50 of each connector is interengaged with the roller massager's side strap 16 or 17. As shown in FIGS. 2 and 3, the upper yoke 48 is inserted over the strap's top edge 58, and the inner yoke 49 is thereby positioned against the inside face 59 of the strap 16 or 17. This locates the inside 44, 45, 63 and outside 46, 47, 64 fingers of the strap connectors 26–28, 26'–28' adjacent the inside 59 and outside 67 faces of the strap 16 or 17 along the upper edge 58 thereof, and locates the inside foot 41, 42, 62 of the strap connectors underneath the bottom edge 68 of the strap. Further, and importantly, as the inside 44, 45 and outside 46, 47 fingers and inside feet 41, 42 are so interengaged with the strap 16 or 17, the open ended keyhole slots 38 are snap fit about the roller rows' axles 15. Accordingly, the snap fit of the keyhole slots 38 about the axles 15 permits legs 39, 40 of the strap connectors 26, 27, 26', 27' to prevent longitudinal movement (in the direction of phantom arrow 70) of the handle 11 relative to the roller 12 matrix, the interfit of the inside 44, 45, 63 and outside 46, 47, 64 fingers relative to the straps 16, 17 prevents transverse movement (in the direction of phantom arrow 71) of the handle 11 relative to the roller 12 matrix, and the interfit of the straps 16, 17 between the inside feet 41, 42, 64 and edge 69 of the webs 29, 60 prevent normal movement (in the direction of phantom arrow 72) of the handle 11 relative to the roller 12 matrix. This, therefore, results in a three dimensional interconnection of the base plate 11 with the straps 16, 17 and, therefor, with the roller 12 matrix, at each of the strap connectors. And with all strap connectors so interfitted or connected with the roller matrix' side straps 16, 17, the handle is operationally connected so that the roller massager 10 can be held in one hand while rolling the rollers 12 over that part of the user's body on which massage is desired.

Having described in detail the preferred embodiment of my invention, what I desire to claim and protect by Letters Patent is:

1. A roller massager comprising a series of roller rows positioned together in a roller matrix configuration, each row's rollers being mounted on an axle, a strap oriented along each side of said matrix, each side strap being connected with said roller axles for connecting said roller rows in matrix configuration, and a handle connectable with and disconnectable from both said straps, said handle cooperating with said roller rows to permit use of said roller matrix with or without said handle attached, and said handle comprising at least two strap connectors, each of said strap connectors being adapted to interfit with a strap and with an axle, said strap connectors cooperating to prevent substantial longitudinal, transverse and normal motion of said handle relative to the plane of said roller matrix during use of said roller massager.

2. A roller massager as set forth in claim 1, said handle comprising a base, and a hinge connecting each strap connector to said base, said hinge permitting said strap connector to move between a storage plane and a use plane, said planes being at least 45° apart one from the other.

3. A roller massager as set forth in claim 2, said handle comprising at least one gusset mounted on one of each strap connector and said base, said gussets cooperating with said connectors and said base to prevent hinging motion of said connectors relative to said base when said handle is interconnected with said roller massager during use of said roller massager.

4. A roller massager as set forth in claim 1, each strap connector comprising an upper yoke defined by an inner finger and an outer finger, and an inner yoke defined by an inner finger and a foot, both said upper yoke and said inner yoke cooperating to prevent normal motion and transverse motion of said handle relative to the plane of said roller matrix during use of said roller massager.

5. A roller massager as set forth in claim 4, each strap connector comprising an open ended keyhole slot structure adapted to snap fit over an axle, said slot structure cooperating with said axle to prevent longitudinal motion of said handle relative to the plane of said roller matrix during use of said roller massager.

6. A roller massager as set forth in claim 5, said handle comprising a base, and a hinge connecting each strap connector to said base, said hinge permitting said strap connector to move between a storage plane and a use plane, said planes being at least 45° apart one from the other.

7. A roller massager as set forth in claim 6, said handle comprising at least two strap connectors hingedly connected with each side edge of said base, thereby providing at least two connection points for said handle with each of said straps.

8. A roller massager as set forth in claim 7, said handle being fabricated from a one piece molded plastic configuration.

9. A roller massager comprising a series of rollers disposed in rows, said rows being located in a matrix configuration, a frame connecting said rollers together one with the other to maintain said matrix configuration, and a handle selectively connectable with and disconnectable from said roller matrix, said handle comprising a base, and at least one connector hingedly mounted to said base, said connector being movable between a storage plane and a use plane, said planes being at least 45° apart one from the other.

10. A roller massager as set forth in claim 9, said frame comprising a strap oriented along each side of said matrix, each side strap being connected with axles on which said rollers are mounted for connecting said roller rows in matrix configuration.

11. A roller massager as set forth in claim 10, said handle comprising at least two strap connectors, each of said strap connectors being adapted to interfit with a strap and with an axle, said strap connectors cooperating to prevent substantial longitudinal, transverse and normal motion of said handle relative to the plane of said roller matrix during use of said roller massager.

12. A roller massager as set forth in claim 11, said handle comprising at least one gusset mounted on one of each strap connector and said base, said gussets cooperating with said connectors and said base to prevent hinging motion of said connectors relative to said base when said handle is interconnected with said roller massager during use of said roller massager.

13. A roller massager as set forth in claim 11, each strap connector comprising an upper yoke defined by an inner finger and an outer finger, and an inner yoke defined by an inner finger and a foot, both said upper yoke and said inner yoke cooperating to prevent normal motion and transverse motion of said handle relative to the plane of said roller matrix during use of said roller massager.

14. A roller massager as set forth in claim 13, each strap connector comprising an open ended keyhole slot structure adapted to snap fit over an axle, said slot structure cooperating with said axle to prevent longitudinal motion of said handle relative to the plane of said roller matrix during use of said roller massager.

15. A roller massager as set forth in claim 14, said handle being fabricated from a one piece molded plastic configuration.

* * * * *